US010653293B1

(12) United States Patent
Morin

(10) Patent No.: US 10,653,293 B1
(45) Date of Patent: May 19, 2020

(54) DRYING AND DRAINING MULTI-LEVELED SHOE RACK SYSTEM

(71) Applicant: Alice Morin, Toronto (CA)

(72) Inventor: Alice Morin, Toronto (CA)

( * ) Notice: Subject to any disclaimer, the term of this patent is extended or adjusted under 35 U.S.C. 154(b) by 0 days.

(21) Appl. No.: 16/249,998

(22) Filed: Jan. 17, 2019

(51) Int. Cl.
*A47L 23/20* (2006.01)
*A47B 61/04* (2006.01)

(52) U.S. Cl.
CPC ..... *A47L 23/20* (2013.01); *A47B 61/04* (2013.01)

(58) Field of Classification Search
CPC ..... A47L 23/20; A47B 61/04; F26B 9/006; F26B 25/063; F26B 25/06; F26B 25/066
USPC .... 34/201, 202, 238, 237, 204, 209; 211/34, 211/36, 37, 188, 194
See application file for complete search history.

(56) References Cited

U.S. PATENT DOCUMENTS 1,278,332 A * 9/1918 Green ..... A47F 7/08 211/36
4,456,316 A * 6/1984 Lundgren ..... A47B 61/04 312/229
5,782,368 A * 7/1998 Roberge ..... A47B 61/04 108/24
7,178,680 B2 * 2/2007 Botner ..... A47B 43/00 108/163
9,109,832 B2 * 8/2015 Hartsook ..... F26B 19/00
9,140,497 B2 * 9/2015 Al-Shahrani ..... F26B 9/10
10,092,099 B1 * 10/2018 Linari ..... A47B 87/0223
10,100,458 B2 * 10/2018 Stewart ..... D06F 28/10
2006/0091087 A1 * 5/2006 Belanger ..... A47B 61/04 211/37
2008/0073300 A1 * 3/2008 Abraitis ..... A47B 61/04 211/36
2011/0048474 A1 * 3/2011 Kim ..... A47L 23/20 134/115 R
2012/0151789 A1 * 6/2012 Hurst ..... A47L 23/20 34/202
2018/0249829 A1 * 9/2018 Gilmour ..... A47B 96/00

* cited by examiner

*Primary Examiner* — Ko H Chan
(74) *Attorney, Agent, or Firm* — Orin Del Vecchio

(57) ABSTRACT

A drying and draining multi-leveled shoe rack system including a modular storage rack having a base including a base-tray, and a base-rack, a plurality of tiers each having a rack, a drainage collection tray, and a pipe system in connection with the plurality of drainage collection trays. The base includes the base-tray and the base-rack, the base-tray is configured to collect water and debris filtered through the base-rack and from the plurality of tiers via the pipe system. The plurality of tiers each has a respective the drainage collection tray being substantially horizontal and positioned below the rack. The modular storage rack provides the drying and draining multi-leveled shoe rack system for collecting and removing the water and the debris from footwear placed thereon. The water and the debris is collected in the drainage collection tray and directed towards the base-tray via the pipe system.

18 Claims, 5 Drawing Sheets

DRYING AND DRAINING MULTI-LEVELED SHOE RACK SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of racks and more specifically relates to a shoe rack.

2. Description of Related Art

Inclement weather conditions can cause footwear to become covered in mud, snow, and other elements. These elements can then be carried into public buildings or private homes, at times creating a nuisance and potential safety hazard. Additionally, footwear storage for large families can be difficult to manage. This issue is enhanced when each family member owns more than one pair of footwear or apparel. Footwear can often collect in a closet or foyer, clutter floors, and distribute slush, water, mud, or other debris to the area adjacent to where footwear is stored. Presently, racks exist that are used to store and drain moisture from footwear, apparel, and other items. A suitable solution is desired.

U.S. Pub. No. 2012/0151789 to John Hurst relates to a storage and drying apparatus for footwear and apparel. The described storage and drying apparatus for footwear and apparel includes a storage and drying apparatus which may comprise a base component, and storage and drying components. The storage and drying component may be a large footwear component, a small footwear component or an apparel component. Any combination of components may be used in connection with the apparatus. A drainage tray may be removeably carried by the base component. The storage and drying components may each include connecting pegs and corresponding connecting holes to receive the connecting pegs so that the storage and drying components may be securely and interchangeably stacked.

BRIEF SUMMARY OF THE INVENTION

In view of the foregoing disadvantages inherent in the known racks art, the present disclosure provides a novel drying and draining multi-leveled shoe rack system. The general purpose of the present disclosure, which will be described subsequently in greater detail, is to provide a modular drying and draining shoe rack with multiple layers for stacking.

A drying and draining multi-leveled shoe rack system is disclosed herein. The drying and draining multi-leveled shoe rack system includes a modular storage rack having a base including a base-tray, and a base-rack, a plurality of tiers each having a rack, a drainage collection tray, and a pipe system in connection with the plurality of drainage collection trays. The modular storage rack is stackable and includes the base and the plurality of tiers. The base includes the base-tray and the base-rack, the base-tray is configured to collect water and debris filtered through the base-rack and from the plurality of tiers via the pipe system. The plurality of tiers each has a respective drainage collection tray being substantially horizontal and positioned below the rack to collect the water and the debris filtered through a plurality of apertures on the rack. The modular storage rack provides the drying and draining multi-leveled shoe rack system for collecting and removing the water and debris from footwear placed thereon. The water and the debris is collected in the drainage collection tray and directed towards the base-tray via the pipe system. Each of the drainage collection trays and the base-tray are removeable.

A kit is also disclosed herein including a base, a plurality of tiers, and a set of instructions.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a drying and draining multi-leveled shoe rack system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to racks and more particularly to a drying and draining multi-leveled shoe rack system as used to improve the water collection and drying of shoes on a shoe rack.

Generally, the invention is a shoe rack having multiple levels. Every level is equipped with a tray and draining pipe that leads the water to the base of the rack. It allows multiple pairs shoes and boots that are worn outside and are wet to be set aside, tidily to be drained and dry.

Figure 1:
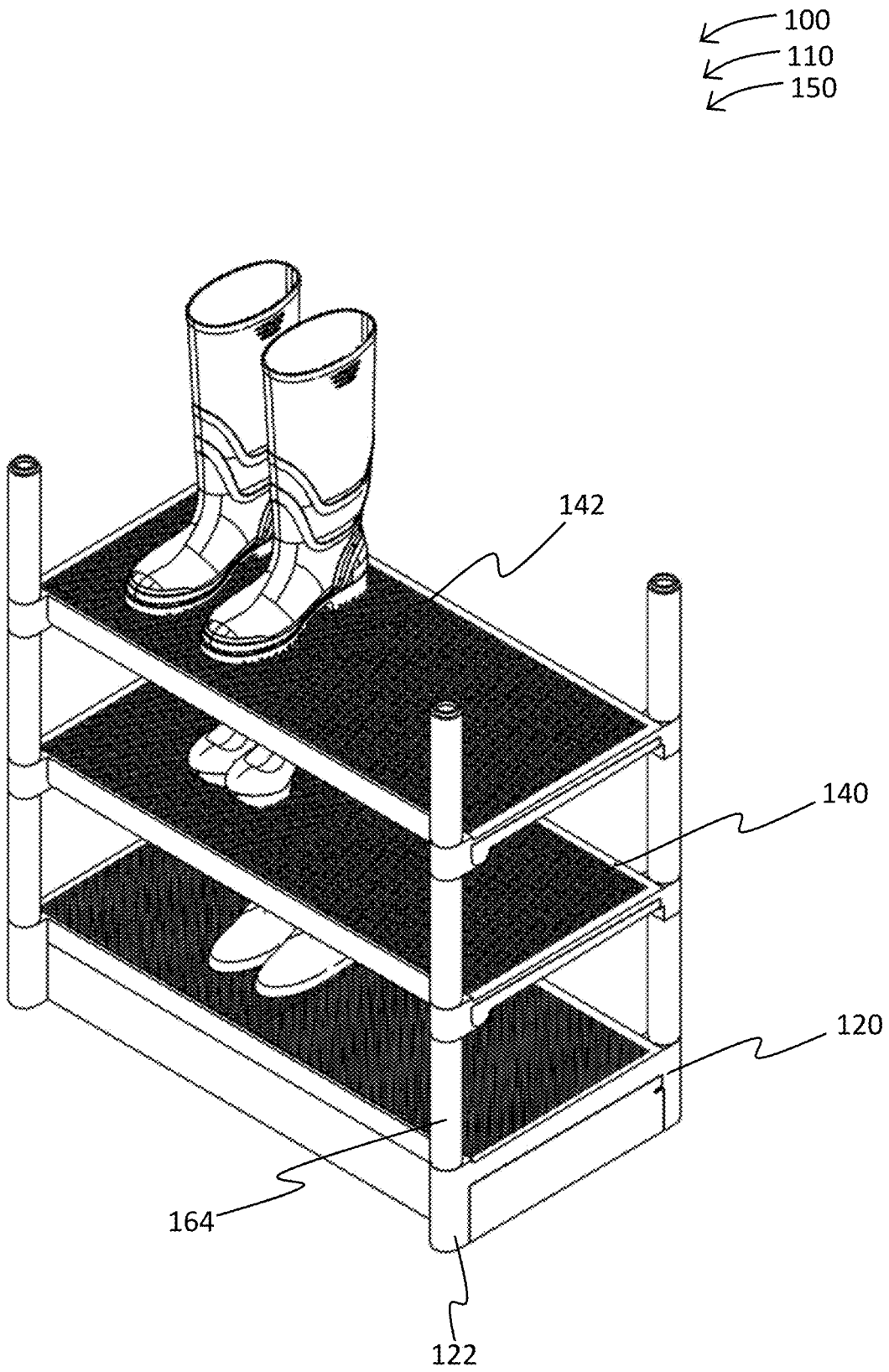
FIG. 1 is a perspective view of the drying and draining multi-leveled shoe rack system during an 'in-use' condition, according to an embodiment of the disclosure.

Referring now more specifically to the drawings by numerals of reference, there is shown in FIGS. 1-5, various views of a drying and draining multi-leveled shoe rack system 100. FIG. 1 shows a drying and draining multi-leveled shoe rack system 100 during an 'in-use' condition 150, according to an embodiment of the present disclosure. As illustrated, the drying and draining multi-leveled shoe rack system 100 may include a modular storage rack 110 having a base 120 including a base-tray 124, and a base-rack 128, a plurality of tiers 140 each having a rack 142, a drainage collection tray 146, and a pipe system 152 in connection with the plurality of drainage collection trays 146.

The modular storage rack 110 is stackable and includes the base 120 and the plurality of tiers 140. The base 120 includes the base-tray 124 and the base-rack 128; the base-tray 124 is configured to collect water and debris filtered through the base-rack 128 and from the plurality of tiers 140 via the pipe system 152. The plurality of tiers 140 each has a respective drainage collection tray 146 being substantially horizontal and positioned below the rack 142 to collect the water and the debris filtered through a plurality of apertures 160 on the rack 142. The modular storage rack 110 provides the drying and draining multi-leveled shoe rack system 100 for collecting and removing the water and the debris from footwear placed thereon. The water and the debris are collected in the drainage collection tray 146 and directed towards the base-tray 124 via the pipe system 152. Each of the drainage collection trays 146 and the base-tray 124 are removeable. The present invention may be coupled to existing plumbing drains or the like in the building it is used in.

Figure 2:
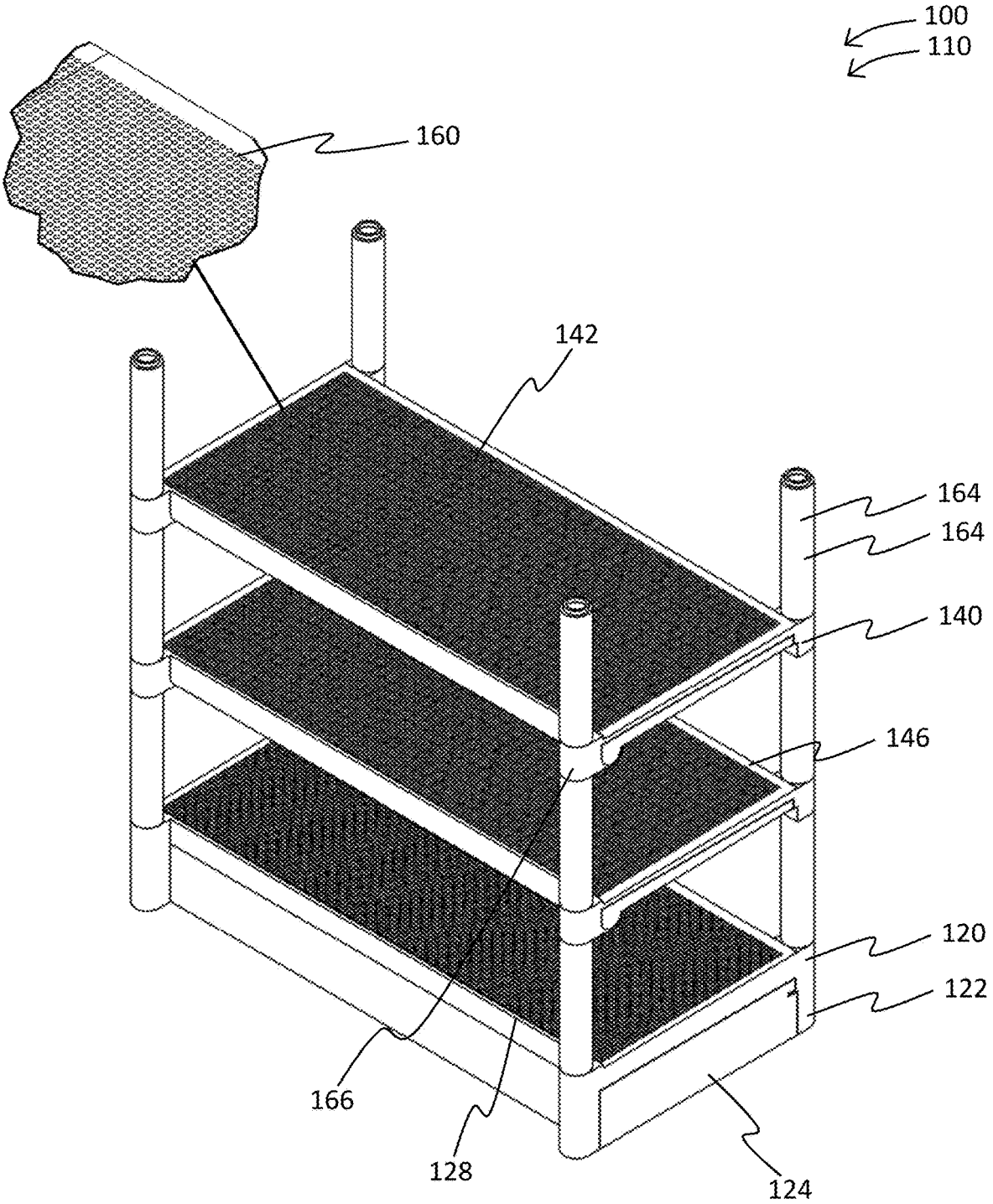
FIG. 2 is a perspective view of the drying and draining multi-leveled shoe rack system of FIG. 1, according to an embodiment of the present disclosure.

FIG. 2 shows a front perspective view of the drying and draining multi-leveled shoe rack system 100 of FIG. 1, according to an embodiment of the present disclosure. As above, the drying and draining multi-leveled shoe rack system 100 may include the base 120 (including the base-tray 124, and the base-rack 128), the plurality of tiers 140 each having a rack 142, the drainage collection tray 146, and the pipe system 152. The drainage collection tray includes an inclination directing the water to the pipe system 152 (via gravity) and through the modular storage rack 110 to the base 120. The pipe system 152 includes legs 164 for stacking the plurality of tiers 140 on one another and on top of the base 120. The legs 164 function as pipes for drainage. The legs 164 of the plurality of tiers 140 include a pair of front-legs and a pair of rear-legs. The rear-legs are hollow and are configured to allow drainage to flow therethrough. The front-legs are not hollow such that water is directed to the rear-legs. The base 120 comprises non-hollow support-legs 122 configured to provide stability and support to the plurality of tiers 140.

The legs 164 of the plurality of tiers 140 are configured to stackably engage a desired number of the plurality of tiers 140 in a vertical orientation. The plurality of tiers 140 comprise at least a first-section 166 and a second-section 168; the first-section 166 configured to mount to the second-section 168 modularly in a vertical series. The first-section 166 includes the rack 142 and drainage collection tray 146 connected to a portion of the pipe system 152. The second-section 168 is an extension of the pipe system 152. The extension extends between each of the plurality of tiers 140 and supports the plurality of tiers 140 in an elevated position above one another. The modular storage rack 110 may include as many of the plurality of tiers 140 that the user desired, all supported on the base 120.

Figure 3:
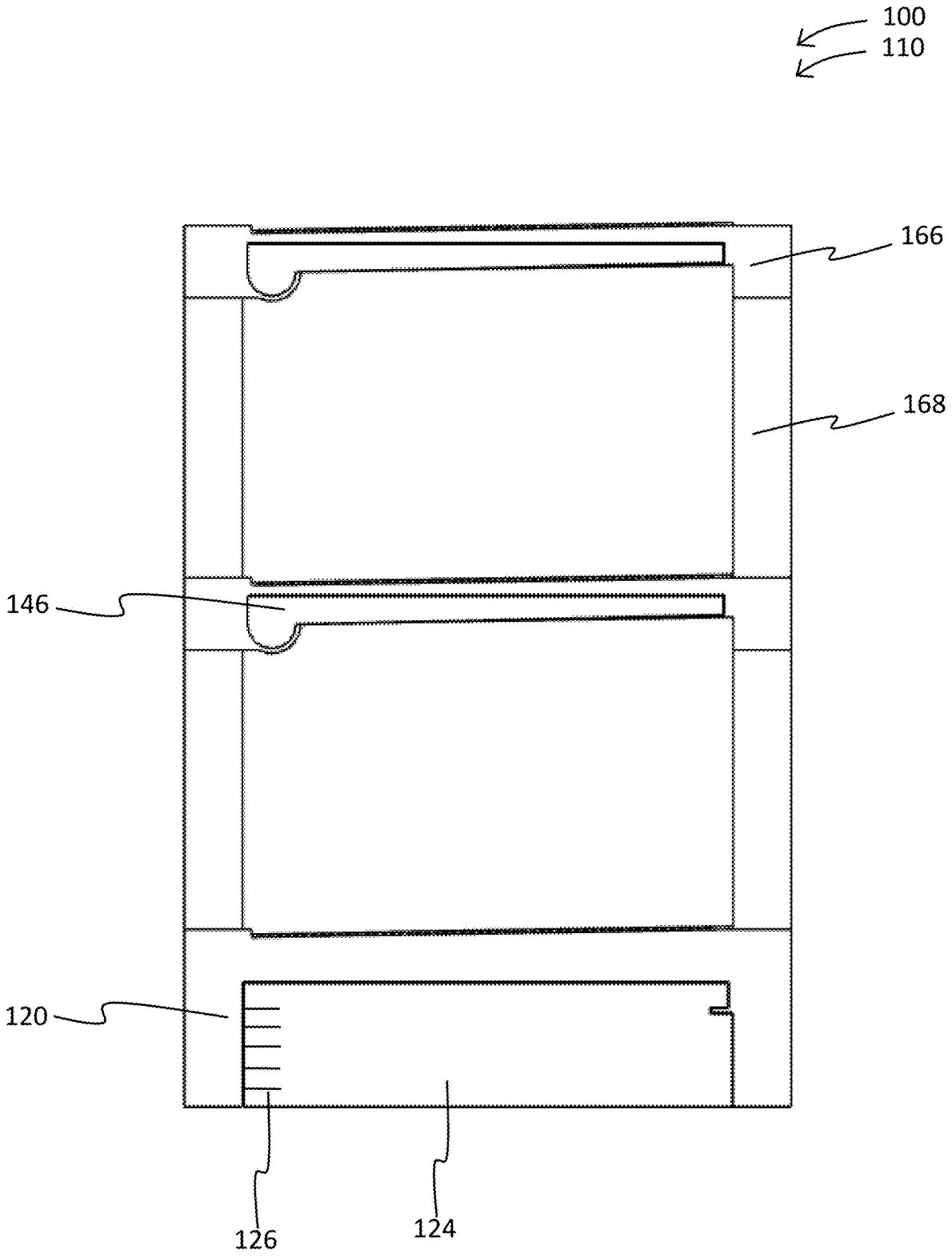
FIG. 3 is a side view of the drying and draining multi-leveled shoe rack system of FIG. 1, according to an embodiment of the present disclosure.

Referring now to FIG. 3 showing a front perspective view of the drying and draining multi-leveled shoe rack system 100 of FIG. 1, according to an embodiment of the present disclosure. As above, the drying and draining multi-leveled shoe rack system 100 may include the base 120 and the plurality of tiers 140. The drainage collection tray 146 and the base-tray 124 are configured to be slideable removed from an open end opposing a closed end. The base-tray 124 comprises a larger collection volume than the drainage collection tray 146 such that the base-tray 124 can store the water and the debris accumulated from the drainage collection tray 146 of each of the plurality of tiers 140. The base-tray 124 comprises measuring indicia 126 allowing a user to measure how full the base-tray 124 is. The base-tray 124 is preferably a tank or large container. The base-tray 124 may be emptied once water and debris is filtered to the base-tray 124 from the plurality of tiers 140.

Figure 4:
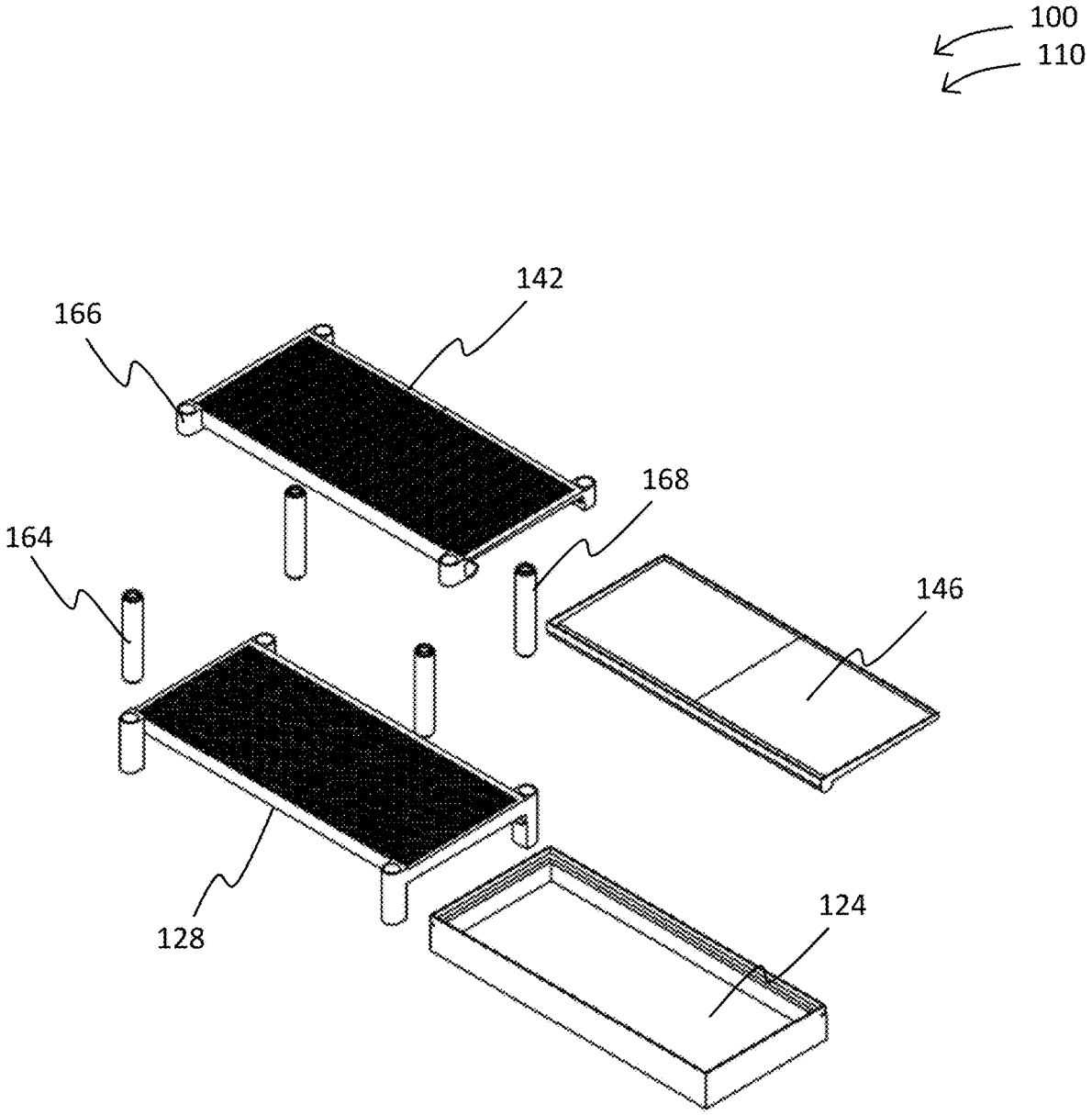
FIG. 4 is an exploded view of the drying and draining multi-leveled shoe rack system of FIG. 1, according to an embodiment of the present disclosure.

FIG. 4 shows a front perspective view of the drying and draining multi-leveled shoe rack system 100 of FIG. 1, according to an embodiment of the present disclosure. As above, the drying and draining multi-leveled shoe rack system 100 may include the base 120 and the plurality of tiers 140 which further include support members 170. The support members 170 of the base 120 are configured for slideably engaging and supporting the base-tray 124 in a position below the base-rack 128. The support members 170 of the plurality of tiers 140 are configured for slideably engaging and supporting the drainage collection tray 146 in a position below the rack 142. The support members 170 support the drainage collection tray 146 and are configured having an angle for directing the water and the debris as collected. The plurality of apertures 160 comprise a diameter sufficient to allow the water and small the debris to pass therethrough without allowing rocks and other large items to pass. The device provides a modular storage rack 110 which may be useful in cold and wet environments to eliminate the mess associated with wet footwear. Coupling of the present invention can be done via any suitable fastening means.

Figure 5:
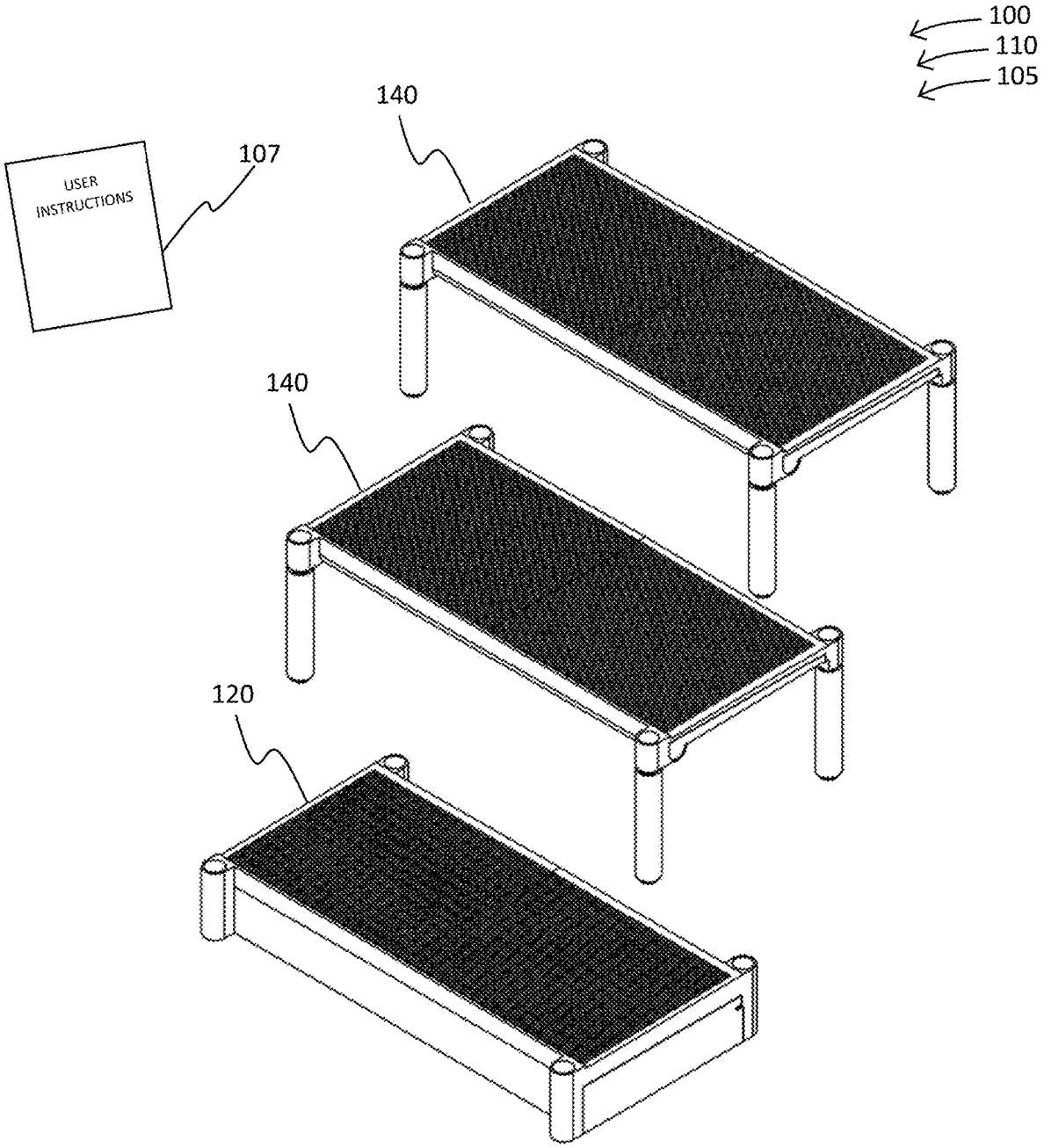
FIG. 5 is a kit of the drying and draining multi-leveled shoe rack system of FIG. 1, according to an embodiment of the present disclosure.

Referring now to FIG. 5 showing a front perspective view of the drying and draining multi-leveled shoe rack system 100 of FIG. 1, according to an embodiment of the present disclosure. As above, the drying and draining multi-leveled shoe rack system 100 may include the base 120 including the base-tray 124, and the base-rack 128, the plurality of tiers 140 each having a rack 142, the drainage collection tray 146, and the pipe system 152. The modular storage rack 110 is configured to be affixable to a wall for stability. The modular storage rack 110 may be mounted in an elevated position on the wall if desired. The device may include rigid plastic materials or other suitable materials to provide an easy to clean and sturdy device. The rigid plastic is suited to support a weight of a plurality of shoes.

According to one embodiment, the drying and draining multi-leveled shoe rack system 100 may be arranged as a kit 105. In particular, the drying and draining multi-leveled shoe rack system 100 may further include a base 120, a plurality of tiers 140, and a set of instructions 107. The instructions 107 may detail functional relationships in relation to the structure of the drying and draining multi-leveled shoe rack system 100 such that the drying and draining multi-leveled shoe rack system 100 can be used, maintained, or the like, in a preferred manner.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A drying and draining multi-leveled shoe rack system comprising:

a modular storage rack having;

a base including;

a base-tray; and a base-rack;

a plurality of tiers each having;

a rack;

a drainage collection tray; and a pipe system in connection with said plurality of drainage collection trays said pipe system providing legs for stacking said plurality of tiers on one another and on top of said base and said legs include a pair of front-legs and a pair of rear-legs;

wherein said modular storage rack is stackable and includes said base and said plurality of tiers;

wherein said base includes said base-tray and said base-rack, said base-tray is configured to collect water and debris filtered through said base-rack and from said plurality of tiers via said pipe system;

wherein each said drainage collection tray of each tier in said plurality of tiers is positioned below each said rack of each tier in said plurality of tiers to collect said water and said debris filtered through a plurality of apertures on each said rack;

wherein said modular storage rack provides said drying and draining multi-leveled shoe rack system for collecting and removing said water and said debris from footwear placed thereon;

wherein said water and said debris is collected in said drainage collection tray and directed towards said base-tray via said pipe system; and wherein each of said drainage collection trays and said base-tray are removeable.

2. The drying and draining multi-leveled shoe rack system of claim 1, wherein each said drainage collection tray includes an inclination directing said water to said pipe system and through said modular storage rack to said base.

3. The drying and draining multi-leveled shoe rack system of claim 1, wherein said rear-legs are hollow and are configured to allow drainage to flow therethrough.

4. The drying and draining multi-leveled shoe rack system of claim 3, wherein said front-legs are not hollow.

5. The drying and draining multi-leveled shoe rack system of claim 1, wherein said legs of said plurality of tiers are configured to stackably engage a desired number of said plurality of tiers in a vertical orientation.

6. The drying and draining multi-leveled shoe rack system of claim 1, wherein said drainage collection tray and said base-tray are configured to be slideable removed from an open end of said each tier.

7. The drying and draining multi-leveled shoe rack system of claim 6, wherein said base-tray comprises a larger collection volume than said drainage collection tray such that said base-tray can store said water and said debris accumulated from said drainage collection tray of each of said plurality of tiers.

8. The drying and draining multi-leveled shoe rack system of claim 7, wherein said base-tray comprises measuring indicia.

9. The drying and draining multi-leveled shoe rack system of claim 1, wherein said base and said plurality of tiers further include support members.

10. The drying and draining multi-leveled shoe rack system of claim 9, wherein said support members of said base are configured for slideably engaging and supporting said base-tray in a position below said base-rack.

11. The drying and draining multi-leveled shoe rack system of claim 9, wherein said support members of said plurality of tiers are configured for slideably engaging and supporting said each drainage collection tray in a position below said each rack.

12. The drying and draining multi-leveled shoe rack system of claim 11, wherein said support members support said drainage collection tray and said support members are configured such that said drainage collection tray is thereby having an angle for directing said water and said debris as collected.

13. The drying and draining multi-leveled shoe rack system of claim 1, wherein said plurality of apertures comprise a diameter sufficient to allow said water and small said debris to pass therethrough.

14. The drying and draining multi-leveled shoe rack system of claim 1, wherein said modular storage rack is configured to be affixable to a wall for stability.

15. The drying and draining multi-leveled shoe rack system of claim 1, wherein said base comprises non-hollow support-legs configured to provide stability and support to said plurality of tiers.

16. The drying and draining multi-leveled shoe rack system of claim 1, wherein said plurality of tiers comprise a first-section and a second-section, said first-section configured to mount to said second-section modularly in a vertical series.

17. A drying and draining multi-leveled shoe rack system, the drying and draining multi-leveled shoe rack system comprising:

a modular storage rack having;

a base including;

a base-tray; and a base-rack;

a plurality of tiers each having;

a rack;

a drainage collection tray; and a pipe system in connection with said plurality of drainage collection trays;

wherein said modular storage rack is stackable and includes said base and said plurality of tiers;

wherein said base includes said base-tray and said base-rack, said base-tray is configured to collect water and debris filtered through said base-rack and from said plurality of tiers via said pipe system;

wherein each said drainage collection tray of each tier in said plurality of tiers is positioned below each said rack of each tier in said plurality of tiers to collect said water and said debris filtered through a plurality of apertures on each said rack;

wherein said modular storage rack provides said drying and draining multi-leveled shoe rack system for collecting and removing said water and said debris from footwear placed thereon;

wherein said water and said debris is collected in said drainage collection tray and directed towards said base-tray via said pipe system;

wherein each of said drainage collection trays and said base-tray are removeable;

wherein each said drainage collection tray includes an inclination directing said water to said pipe system and through said modular storage rack to said base;

wherein said pipe system provides legs for stacking said plurality of tiers on one another and on top of said base;

wherein said legs include a pair of front-legs and a pair of rear-legs;

wherein said rear-legs are hollow and are configured to allow drainage to flow therethrough;

wherein said front-legs are not hollow;

wherein said legs of said plurality of tiers are configured to stackably engage a desired number of said plurality of tiers in a vertical orientation;

wherein said drainage collection tray and said base-tray are configured to be slideable removed from an open end of said each tier;

wherein said base-tray comprises a larger collection volume than said drainage collection tray such that said base-tray can store said water and said debris accumulated from said drainage collection tray of each of said plurality of tiers;

wherein said base-tray comprises measuring indicia;

wherein said base and said plurality of tiers further include support members;

wherein said support members of said base are configured for slideably engaging and supporting said base-tray in a position below said base-rack;

wherein said support members of said plurality of tiers are configured for slideably engaging and supporting said each drainage collection tray in a position below said each rack;

wherein said support members support said drainage collection tray and said support members are configured such that said drainage collection tray is thereby having an angle for directing said water and said debris as collected;

wherein said plurality of apertures comprise a diameter sufficient to allow said water and small said debris to pass therethrough;

wherein said base comprises non-hollow support-legs configured to provide stability and support to said plurality of tiers; and wherein said plurality of tiers comprise a first-section and a second-section, said first-section configured to mount to said second-section modularly in a vertical series.

18. The drying and draining multi-leveled shoe rack system of claim 17, further comprising said base;

said plurality of tiers; and a set of instructions; and wherein the drying and draining multi-leveled shoe rack system is arranged as a kit.

* * * * *